US005823813A

United States Patent [19]

Dye

[11] Patent Number: 5,823,813

[45] Date of Patent: Oct. 20, 1998

[54] CONNECTOR POSITION ASSURANCE DEVICE

[75] Inventor: David Eugene Dye, Rancho Santa Margarita, Calif.

[73] Assignee: ITT Manufacturing Enterprises, Inc., Wilmington, Del.

[21] Appl. No.: 786,460

[22] Filed: Jan. 21, 1997

[51] Int. Cl.[6] ..... H01R 13/62

[52] U.S. Cl. ..... 439/347; 439/358

[58] Field of Search ..... 439/347, 349, 439/352, 353, 357, 358

[56] References Cited

U.S. PATENT DOCUMENTS

| | | | |
|---|---|---|---|
| 2,619,515 | 11/1952 | Doane | 173/328 |
| 2,677,811 | 5/1954 | Anderson et al. . | |
| 2,918,521 | 12/1959 | Abrams | 174/152 |
| 3,125,395 | 3/1964 | Swanson . | |
| 3,327,282 | 6/1967 | Krolak . | |
| 3,398,391 | 8/1968 | Brishka . | |
| 3,613,048 | 10/1971 | Brandza . | |
| 3,644,938 | 2/1972 | Slate . | |
| 3,671,920 | 6/1972 | Iantorno et al. . | |
| 3,681,739 | 8/1972 | Kornick . | |
| 3,719,918 | 3/1973 | Kerr . | |
| 3,897,131 | 7/1975 | Stauffer . | |
| 4,084,875 | 4/1978 | Yamamoto . | |
| 4,150,866 | 4/1979 | Snyder, Jr. et al. . | |
| 4,214,802 | 7/1980 | Otani et al. . | |
| 4,420,210 | 12/1983 | Karol et al. . | |
| 4,445,744 | 5/1984 | Sedig et al. . | |
| 4,460,227 | 7/1984 | Ball . | |
| 4,519,662 | 5/1985 | Riley et al. . | |
| 4,643,506 | 2/1987 | Kobler . | |
| 4,648,672 | 3/1987 | Kobler . | |
| 4,671,591 | 6/1987 | Archer . | |
| 4,711,511 | 12/1987 | Noorily | 439/347 |
| 4,753,602 | 6/1988 | Peyrat et al. | 439/78 |
| 4,836,801 | 6/1989 | Ramirez | 439/322 |
| 4,941,847 | 7/1990 | Welsh | 439/595 |
| 5,011,426 | 4/1991 | Colleran et al. | 439/347 |
| 5,021,001 | 6/1991 | Ramirez | 439/349 |
| 5,115,563 | 5/1992 | Wilson | 29/876 |
| 5,158,479 | 10/1992 | Mouissie | 439/589 |
| 5,219,185 | 6/1993 | Oddenino | 285/26 |
| 5,266,045 | 11/1993 | Yamamoto et al. | 439/275 |
| 5,299,949 | 4/1994 | Fortin | 439/275 |
| 5,498,171 | 3/1996 | Semaan | 439/352 |
| 5,639,255 | 6/1997 | Muzslay | 439/347 |
| 5,681,178 | 10/1997 | Kunkle et al. | 439/352 |

FOREIGN PATENT DOCUMENTS

| | | |
|---|---|---|
| 0 214 617 A2 | 9/1986 | European Pat. Off. . |
| 3725261 A1 | 7/1987 | Germany . |
| 3804107 A1 | 2/1988 | Germany . |
| 1060271 | 1/1964 | United Kingdom . |

*Primary Examiner*—Hien Vu
*Attorney, Agent, or Firm*—Thomas L. Peterson

[57] ABSTRACT

A device (70) is provided for a pair of clip lock connectors (12, 14), wherein the device can be slid forward (F) from a release position to a locked position, only when the connectors are fully mated, and which then prevents connector unmating unless the device is slid back to its release position. The device has a pair of bars (80) which, in the release position, lie rearward of spring sides (24, 26) of a spring clip (20). During initial mating of the connectors, the spring sides block forward movement of the bars. When full connector mating is reached and the spring sides snap into slots, the device can be slid forward to its locked position and the bars lie immediately outside the spring sides. The device has deflectable arms (92, 110) and is initially held in its release position by a wall (102) on an arm projection (90), which lies behind a barrier (94). As the connectors mate, a cam (96) on the second connector engages a cam follower (106) on the arm projection to deflect it so the wall disengages the barrier and the device can be slid forwardly to its locked position.

7 Claims, 4 Drawing Sheets

10
12
14
16
20
22
24
26
30
32
34
36
38
40
42
44
50
52
54
60
70
72
74
76
80
84
86
88
90
92
94
96
130
132
A
B
F
R

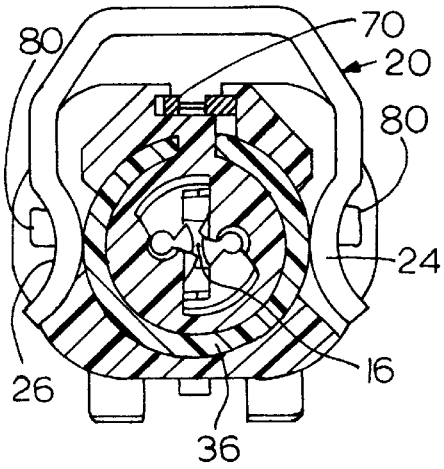
FIG. 11
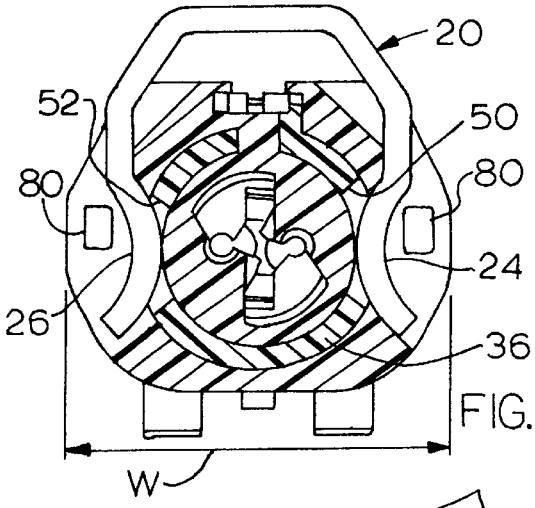
FIG. 12
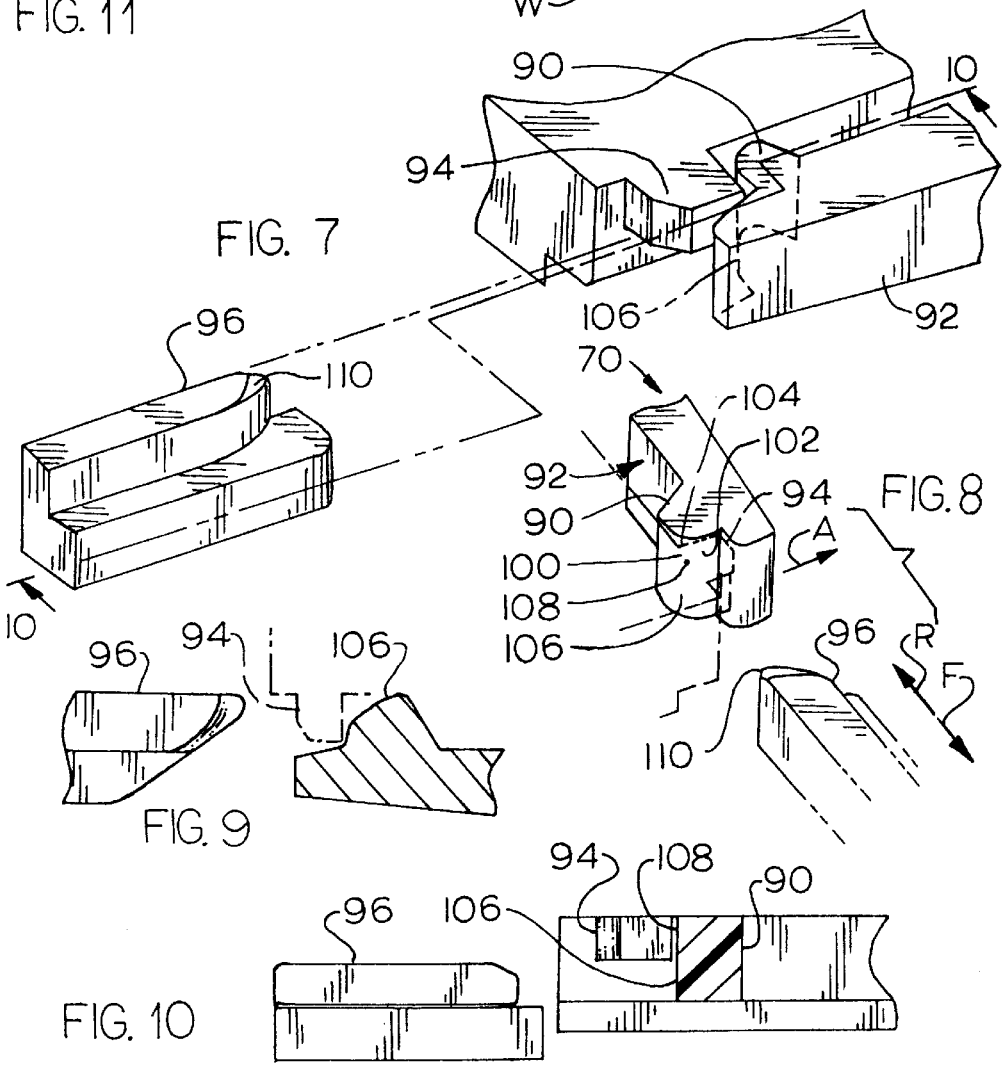
FIG. 7
FIG. 8
FIG. 9
FIG. 10

CONNECTOR POSITION ASSURANCE DEVICE

BACKGROUND OF THE INVENTION

One popular type of electrical connector system includes clip lock connectors, described in U.S. Pat. No. 5,460,549. In that system, a first connector has a clip or spring in the form of a spring wire bent into a U-shape, with opposite legs or spring sides. A mating second connector has a sleeve that pushes apart the spring sides, until the spring sides reach slots in the sleeve and snap into them. One problem with such a connector, is that a technician may not fully mate the connectors, so the spring sides press against the sleeve and resist movement but have not yet reached the slots. A connector position assurance device for operation by a technician after mating the connectors, which could not be slid to a locked position until the connectors were fully mated, would be of value.

SUMMARY OF THE INVENTION

In accordance with one embodiment of the present invention, a connector position assurance device is provided for use with connectors of the clip lock type, which enables a technician to assure that the connectors are fully mated and which locks the connectors in their fully mated positions. Where a first connector has a spring with spring sides that move radially inwardly as they snap into a slot of a mating second connector, the device has bars that lie in line with the spring sides until the spring sides snap into the slots. Only then can the slide be slid to its full forward position. At the full forward position of the device, its bars prevent the spring sides from moving radially out of the slot, to prevent unmating of the connectors.

The novel features of the invention are set forth with particularity in the appended claims. The invention will be best understood from the following description when read in conjunction with the accompanying drawings.

BRIEF DESCRIPTION OF THE DRAWINGS

FIG. 7 is a partial exploded isometric view of the connector system of FIG. 3.

FIG. 8 is an isometric view of a portion of the connector system of FIG. 7.

FIG. 9 is a plan view of a portion of the connector system of FIG. 8.

FIG. 10 is a view taken on line 10—10 of FIG. 7.

FIG. 11 is a view taken on line 11—11 of FIG. 4.

FIG. 12 is a view taken on line 12—12 of FIG. 5.

DESCRIPTION OF THE PREFERRED EMBODIMENT

Figures 1, 2:
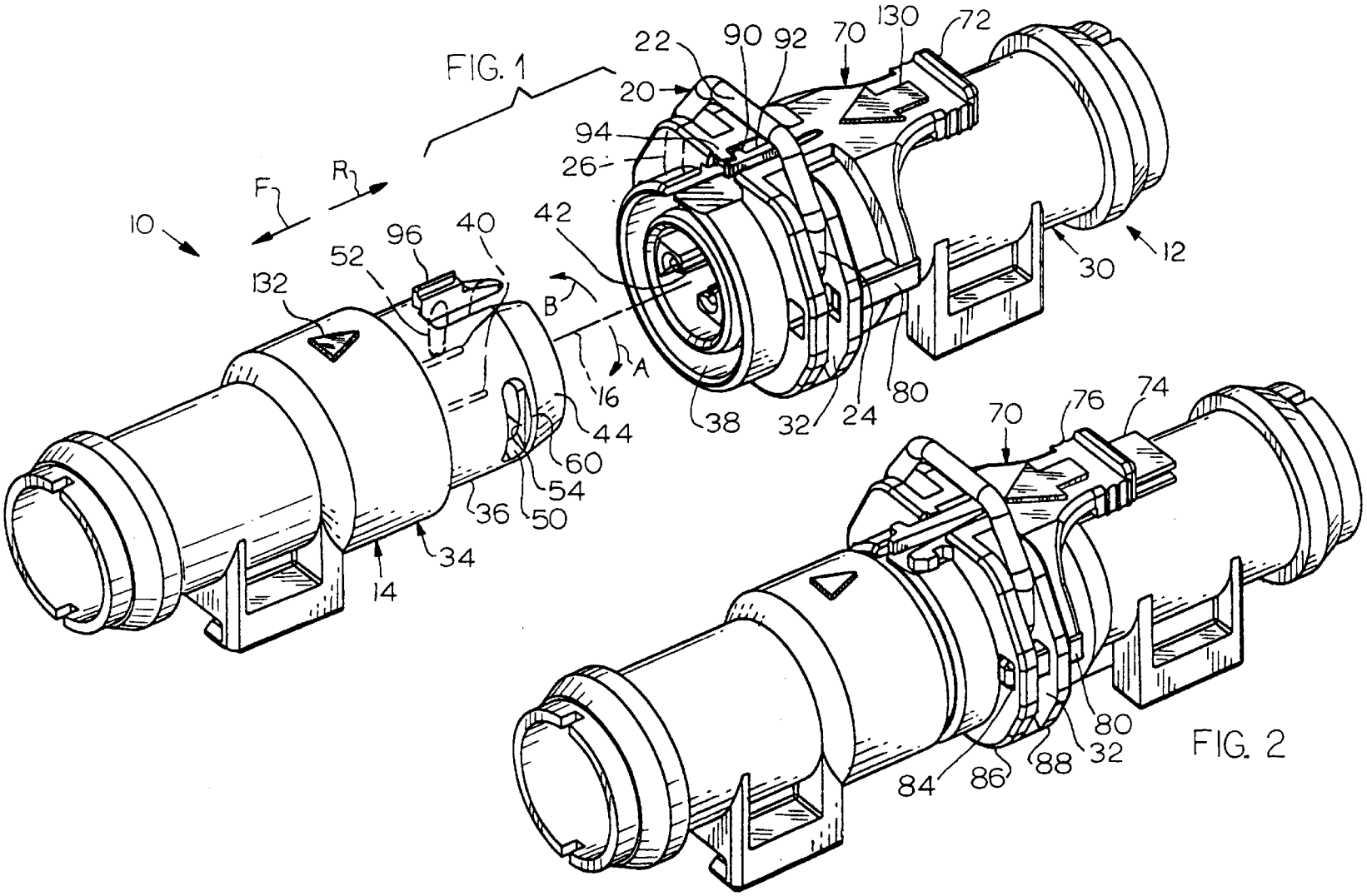
FIG. 1 is an exploded isometric view of the connector of the present invention.
FIG. 2 is an isometric view of the connector system of FIG. 1, with the connectors fully mated.

FIG. 1 illustrates a clip lock connector system 10 which includes first and second connectors 12, 14 that can be mated by moving them together, so that the second connector 14 moves rearwardly R relative to the first and therefore the first moves forwardly F relative to the second, along an axis 16. The first connector has a latch element 20 in the form of a wire spring bent into a U-shape, with a base 22 and opposite legs, or spring parts, or spring sides 24, 26. The first connector has a housing 30 that forms a pair of grooves 32 that hold the spring sides 24, 26. The second connector 14 has a housing 34 with a sleeve portion 36 that can be received in a passage 38 of the first connector. As the connectors mate, a pair of pin contacts 40 of the second connector mate with socket contacts 42 of the first connector. During mating, a tapered forward portion 44 of the sleeve presses the spring sides 24, 26 apart so they move radially outward (away from axis 16). When the connectors are fully mated, so their contacts are fully engaged, the spring sides 24, 26 snap into grooves 50, 52 in the second connector sleeve, to thereby latch the connectors together. The grooves have primarily forwardly-facing walls 54 or second shoulders against which the spring sides rest, to prevent connector unmating. It can be seen that in the latched position of FIG. 5, the spring part 26 lies immediately forward of and in line with the shoulder 54. The connectors can be unmated, or disconnected, by a technician pressing the spring base 22 radially inwardly (towards the axis 16), which results in the spring sides deflected partially out of the slots. This type of connector is described in U.S. Pat. Nos. 5,460,549 and 5,639,255.

There is a possibility that when a technician attempts to mate the connectors, he will stop pushing them together when the spring sides lie against a sleeve location such as 60, wherein the spring sides have not yet snapped into the slots 50, 52. Both the tapered portion and location 60 form largely axially-extending spring-deflecting walls that cause or keep the spring sides 24, 26 in their radially outward, or unlatched positions. Although the sideward force of the spring sides against location 60 tends to keep the connectors together, the connectors then can disconnect due to vibrations etc. Furthermore, even when the connectors are fully mated, there is a possibility that the spring sides will deflect out of the slots 50, 52 if the springs have lost some resilience. A position assurance device which a technician can operate after full mating, which could not be operated unless there was, in fact, full mating, and which prevented disconnection when the device was fully operated, would avoid the above problems with prior art connectors.

In accordance with the present invention, applicant provides a connector position assurance device 70 which is slidably mounted on the first connector 12 to slide between the release position shown in FIG. 1, and forwardly F to the lock position shown in FIG. 2, and back again. The device 70 cannot be slid forward to its lock position unless the connectors are fully mated. In its lock position, the device prevents disconnection unless it is first slid rearwardly R, although in many applications it would be sufficient if the device only indicated full mating when moved to a "lock" position that indicated that the connectors are locked together by the spring latch element.

The position assurance device has a rear portion 72 which is slidably mounted on a guide 74 (FIG. 2) and which forms handles 76 on opposite sides for gripping by a person's fingers. The device also has a pair of device parts or bars 80 which slide within passages 84 formed on a pair of flanges 86, 88 of the first connector. The flanges 86, 88 form the spring-holding grooves 32. It can be seen that in FIG. 1, that when the device is in its release position, the bars do not lie radially outside the spring sides such as 24. However, in the lock position of FIG. 2, the bars lie closely radially outside the spring sides such as 24. FIG. 11 shows the connectors partially mated, with a sleeve portion 36 of the second connector holding the spring sides 24, 26 in their radially outward positions (with respect to the axis 16). FIG. 12 shows the connectors fully mated, with the spring sides 24, 26 having snapped into the slots 50, 52 of the sleeve portion so the spring sides are in their radially inward positions. In the partially mated position of FIG. 11, the spring sides are in their unlatched positions wherein they lie in line with the bars 80 of the position assurance device 70; then, the bars 80 cannot be moved forward. However, in the fully mated position of FIG. 12, the spring sides are in their latched position wherein they are not aligned with the bars, so the bars can slide forwardly. The term "in line" or "aligned" means that one object (or a part thereof) lies forward or rearward of the other, along a direction parallel to the axis 16.

When the connectors are unmated, the spring 20 assumes the position of FIG. 12, wherein the spring sides 24, 26 are in their radially inward or latched positions. If the position assurance device 70 had been moved forwardly to its lock position, then the connectors could not mate (without breaking parts). Applicant constructs the device 70 to assure that it will remain in the release position prior to mating. FIG. 1 shows that this is accomplished by providing the device 70 with a projection 90 on a deflectable arm 92, wherein an upper portion of the projection 90 lies immediately rearward of a barrier 94 of the first connector housing. The barrier 94 prevents the device 70 from sliding forwardly, until the arm 92 and its projection 90 are deflected. The second connector is provided with a cam 96 that engages a lower portion of the projection 90 to deflect it and the arm 92 sidewardly, in a direction A that is circumferential to the axis 16.

FIG. 8 shows that the projection 90 has an upper portion 100 that forms a forwardly-facing arm wall 102 which lies immediately behind a shoulder 104 of the barrier 94. The projection 90 also has a lower portion 106 that forms a cam follower that is designed to be moved by the cam 96 of the second connector. When the second connector and its cam 96 move in the rearward direction R (relative to the first connector) the cam 96 engages the cam follower 106 and deflects it and the arm 92 in the circumferential direction A. The arm is deflected far enough that the projection wall 102 is largely out of line with the barrier shoulder 104, so that the device 70 can be moved in the forward direction F. It is noted that a location 108 on the projection is rounded, so even if that location 108 lies in line with the barrier shoulder 104, the arm can still pass forwardly beyond the barrier. Applicant can form the cam follower 106 of the projection with a more inclined surface to more easily be deflected by the cam 96, although this is usually not necessary. It is noted that the cam 96 is provided with a rear end 110 which is inclined from an axial direction, so it extends at a radially inward-rearward incline. This helps assure that the cam 96 will pass under the barrier 94 and engage the cam follower 106.

Figure 3:
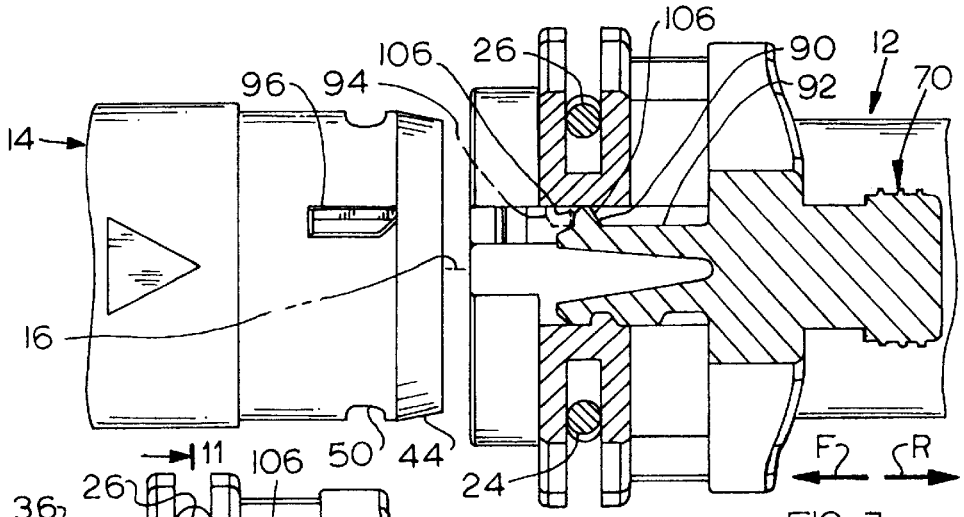
FIG. 3 is an exploded partially sectional top view of the connector system of FIG. 1, with the connectors not mated.
Figure 4:
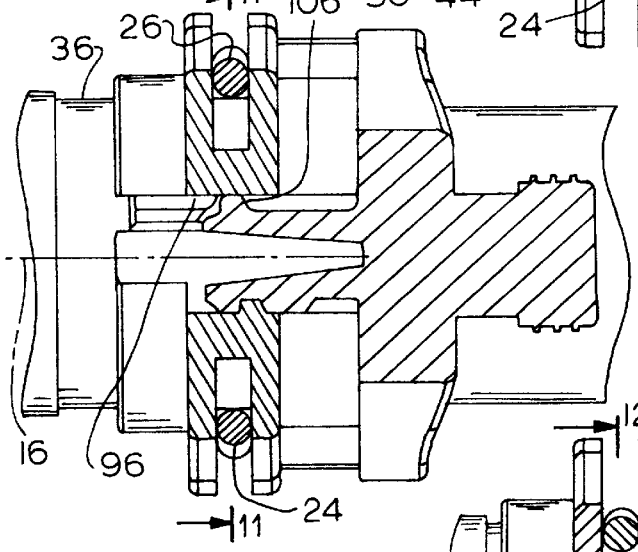
FIG. 4 is a view similar to that of FIG. 3, with the connectors only partially mated.

FIG. 3 shows the connectors 12, 14 as they approach each other for connection. The position assurance device 70 is in its rearward or release position, with the projection 90 lying rearward of and in line with the barrier 94 and with the cam follower 106 of the projection lying below the level of the barrier. The spring sides 24, 26 lie in radially inward positions. FIG. 4 shows the connectors partially mated, with the sleeve portion 36 having radially outwardly deflected spring sides 24, 26. However, the cam 96 has not yet reached the cam follower 106.

Figure 5:
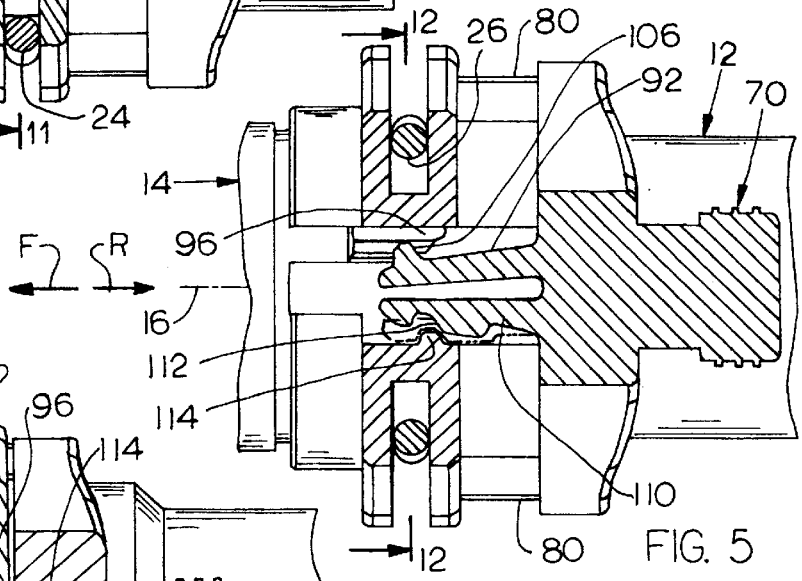
FIG. 5 is a view similar to that of FIG. 4, with the connectors fully mated, but with the connector position assurance device not yet slid forwardly.

FIG. 5 shows the connectors 12, 14 in their fully mated positions, that is, with the second connector pressed as far rearward as it can into the first connector. The spring sides 24, 26 have now moved substantially radially inwardly towards the axis 16, so the bars 80, 82 on the device 70 are not restricted from moving forward and can slide across the spring sides (radially outward of the spring sides). The cam 96 has deflected the cam follower 106 and the first arm 92, so the device 70 can now be moved forwardly. It is noted that the device 70 includes a second arm 110 which is deflected radially towards the first arm when the device 70 is moved forwardly, due to inclined surfaces (inclined more than 15° to circumferential directions) such as a second surface 112 on the second arm and a second surface on a deflector 114 on the first connector housing. The second arm 110 is provided to avoid large circumferential (with respect to axis 16) forces on the front end of the connector 70 which would tend to tilt it (and possibly cause high friction and even malfunction). Thus, when the device 70 is pushed forwardly with a moderate force (more than 50 grams) such as one-half kilogram, after the connectors have been mated, device 70 will slide forwardly.

Figure 6:
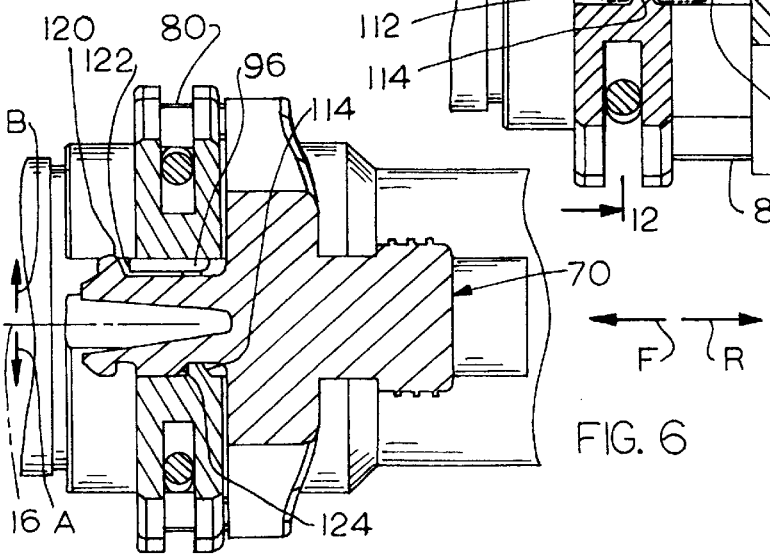
FIG. 6 is a view similar to that of FIG. 5, but with the connector position assurance device slid forwardly to its locked forward position.
Figure 13:
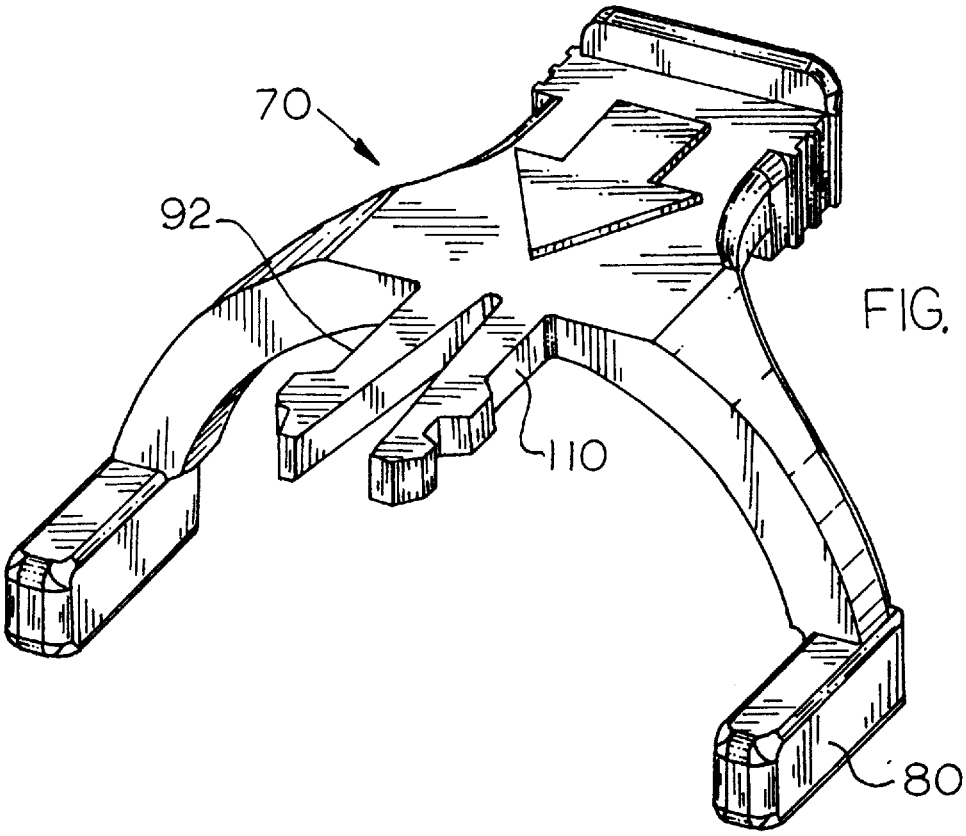
FIG. 13 is a front isometric view of the connector position assurance device of FIG. 1.
Figure 14:
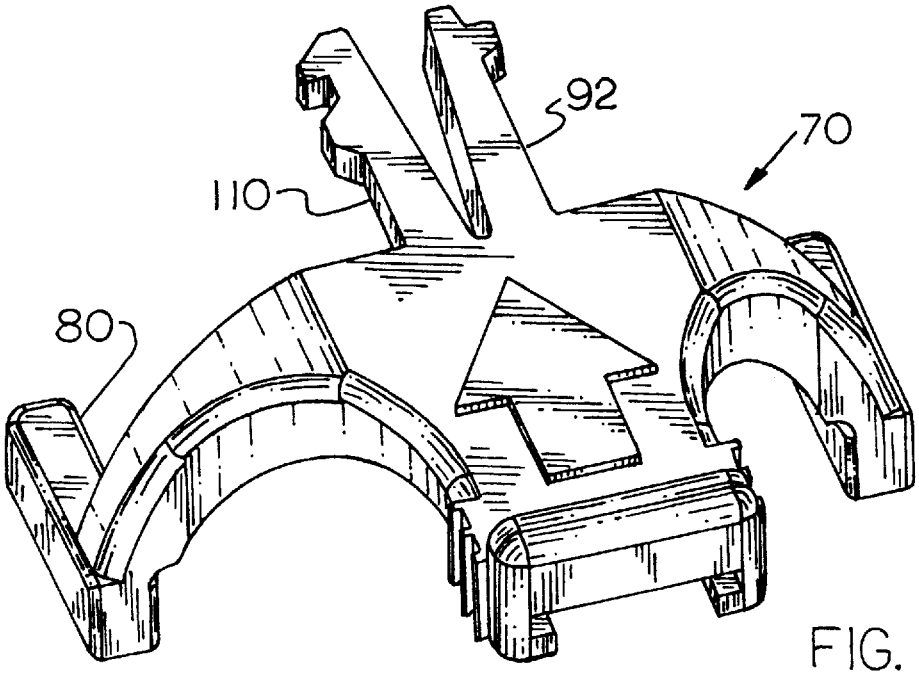
FIG. 14 is a rear isometric view of the connector assurance device of FIG. 13.

FIG. 6 shows the connectors fully mated and the device 70 in its fully forward and locked position. In this position of the device, a first lock surface 120 on the lower part of the first arm projection lies immediately forward of a second lock surface 122 at the front end of the cam 96. The first lock surface 120 is inclined to the circumferential directions A, B so a large rearward force will deflect the first arm to enable the device 70 to move rearwardly. Similarly, an inclined surface 124 on the second arm allows it to deflect out of the way of the deflector 114. It requires a rearward force such as three kilograms, to move the device 70 rearwardly, from its locked position to its release position.

Referring again to FIG. 1, it can be seen that the first and second connectors have markings 130, 132 in the form of arrows. The arrow 130 on the connector position assurance device 70 indicates the direction that the device should be pushed (after full connector mating) to move the connector to its locked position and assure that the connectors have been fully mated. The two arrows 130, 132 also serve to indicate the relative rotational positions about the axis 16, that the connectors must assume in order for them to mate. A technician attempting to mate the connectors will turn them about the axis 16 until the arrows 130, 132 are aligned, and will then push them together.

In a system of the construction illustrated that applicant has designed, the first connector has a housing width W (FIG. 12) of 19.4 mm. The other dimension of the connectors are relative to the width as illustrated in FIGS. 1–6 and 11–14.

Thus, the invention provides a connector position assurance device that is slidably mounted between locked and release positions on a connector of a connector system, especially one with clip lock connectors, to provide assurance to a technician that the two connectors are fully mated and to provide additional retention to prevent unintended unmating of the connectors. Where the connectors are the clip lock type that includes a spring with spring sides that ride over surfaces of a second connector and move radially inwardly in front of shoulders on the second connector, the device can have bars interact with the spring sides. The bars are aligned with the spring sides and cannot move forward, when the spring sides ride over the second connector but before the spring sides snap into place. When connectors are fully mated and the device is moved to a locked position, its bars prevent radially outward deflection of the spring sides, to prevent connector disengagement. The device is initially held in a release position by a barrier on the housing of a first connector, where the barrier is in line with a portion of an arm projection on the device. As the connectors mate, a cam on the second connector deflects the projection and therefore the arm, so the device can be slid toward its locked position.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. In a connector system that includes first and second connectors (12, 14) that have first and second housings (30, 34), respectively, wherein said connectors can be mated by moving said second connector rearwardly (R) along an axis relative to said first connector, where said second connector housing forms a groove with a primarily forwardly-facing shoulder (54) and said first connector has a spring element (20) with a spring part (24, 26) that is movable on said first housing between an unlatched position prior to full mating of said connectors, and a latched position wherein said spring part lies in said groove to lie in line with said shoulder (54) when said connectors fully mate to prevent them from unmating, the improvement comprising:

a connector position assurance device (70) which includes a handle and a device bar (80) which is slidably mounted into a passage formed in one of said connectors between unlock and lock positions, wherein when said device bar is in said unlock position, said spring part lies directly in line with said device bar (80) and prevents said device bar from sliding toward its lock position, but when said spring part (24, 26) lies in said latched position, said spring part lies out of line with said device bar to allow said device bar (80) to slide toward its lock position;

said handle being moveable in opposite forward and rearward directions to slide said device bar in said opposite directions (F, R) without substantial bending, with said spring element being bendable.

2. The system described in claim 1 wherein:

said spring element is formed from a bent niece of metal wire, while said housings and said device are formed of molded plastic.

3. The system described in claim 1 wherein:

said device is slidably mounted on said first housing to slide in forward and rearward axial directions, and said device has a first arm (92) that is circumferentially (A,B) deflectable and that has a forwardly facing arm wall (102) and a cam follower (106);

said first housing has a barrier (94) with a rearwardly-facing barrier shoulder (104) in line with said arm wall to prevent said arm and said device from sliding forwardly toward said lock position;

said second housing has a cam (96) that is positioned to engage said cam follower (106) and move said arm wall out of line with said barrier shoulder, so said device can be slid forwardly.

4. The system described in claim 3 wherein:

said arm has a circumferentially-extending projection, with a radially outer part of said projection forming said arm wall, and with a radially inner part of said projection forming said cam follower, with said cam positioned to slide axially along a path lying radially inward of said barrier.

5. The system described in claim 3 wherein:

said device includes a second arm, with each of said arms being circumferentially deflectable;

said second arm has a second arm surface and said first housing has a second housing surface lying immediately forward of arm second surface in said release position of said device, with one of said second surfaces being inclined from a circumferential direction to thereby allow forward device sliding only when a forward force is applied to said device;

said second surfaces lying on a side of said second arm opposite said first arm, to thereby cause arm deflection to result in the arms being deflected toward each other.

6. The system described in claim 1 wherein:

said device is slidably mounted on said first connector to slide in forward and rearward axial directions thereon, but is prevented from circumferential movement on said first housing;

said first and second connectors are mateable only when they are in predetermined relative rotational positions about said axis;

said device has an arrow marking, which points in an axial direction in which said device slides from said release position to said lock position;

an arrow marking on said second housing, with said arrow markings lying at the same rotational positions around said axis only when said connectors are in said predetermined mate relative rotational positions about said axis.

7. A first electrical connector which is designed to mate with a second electrical connector by relative movement of said second connector rearwardly along an axis into engagement with said first connector, where said first connector has a first housing and has a spring element that is mounted on said first housing and that has radially opposite spring sides for moving from radially outward positions to radially inward positions to hold to said second connector against forward unmating movement when said connectors are fully mated, wherein:

said first connector includes a position assurance device that is slidable in forward and rearward directions on said first housing between a rearward release position and a forward position, said device having a pair of bars with front ends lying rearward of said spring sides and in line with said spring sides when said spring sides lie in said radially outward positions, but with said bars lying substantially radially outward of a position in line with said spring sides when said spring sides lie in said radially inward positions to allow said bars to slide across said spring sides;

said first housing including passages (84) that confine each of said bars to sliding through said passages without substantial deflection of said bars.

* * * * *